US008893697B2

(12) United States Patent
Foeller

(10) Patent No.: US 8,893,697 B2
(45) Date of Patent: Nov. 25, 2014

(54) MULTIPLE SOFT PROJECTILE BLOW GUN

(71) Applicant: Mark R Foeller, Grass Lake, MI (US)

(72) Inventor: Mark R Foeller, Grass Lake, MI (US)

( * ) Notice: Subject to any disclaimer, the term of this patent is extended or adjusted under 35 U.S.C. 154(b) by 16 days.

(21) Appl. No.: 13/741,002

(22) Filed: Jan. 14, 2013

(65) Prior Publication Data

US 2013/0180513 A1 Jul. 18, 2013

Related U.S. Application Data

(60) Provisional application No. 61/586,789, filed on Jan. 15, 2012.

(51) Int. Cl.
*F41B 1/00* (2006.01)
*F41B 15/02* (2006.01)

(52) U.S. Cl.
CPC .. *F41B 1/00* (2013.01); *F41B 15/02* (2013.01)
USPC ..... 124/62

(58) Field of Classification Search
CPC ..... F41B 1/00; F41B 11/51; F41B 11/55; F42B 6/00; F42B 6/003
USPC ..... 124/47, 62, 61, 48, 69, 45, 82
See application file for complete search history.

(56) References Cited

U.S. PATENT DOCUMENTS

| | | | | |
|---|---|---|---|---|
| 1,152,447 | A * | 9/1915 | Sproull | 124/62 |
| 2,427,490 | A * | 9/1947 | Berrayarza et al. | 124/62 |
| 2,580,613 | A | 1/1952 | Seibel et al. | |
| 3,124,119 | A | 3/1964 | Ayala | |
| 3,137,287 | A | 6/1964 | De Arbun | |
| 3,388,696 | A * | 6/1968 | Hoverath et al. | 124/62 |
| 4,054,120 | A | 10/1977 | Foley | |
| 4,086,902 | A | 5/1978 | Reynolds | |
| 4,586,482 | A | 5/1986 | Di Pietro | |
| 5,373,832 | A | 12/1994 | D'Andrade | |
| 5,544,642 | A | 8/1996 | Guthrie | |
| 5,850,826 | A * | 12/1998 | Guthrie | 124/62 |
| 6,347,621 | B1 | 2/2002 | Guthrie | |
| 6,588,413 | B2 | 7/2003 | Nagasue | |
| 6,901,922 | B2 | 6/2005 | Forti et al. | |
| 7,578,290 | B2 | 8/2009 | Mitchell | |
| 8,037,877 | B2 | 10/2011 | Liao | |
| 8,220,447 | B1 | 7/2012 | Harrison | |
| 2006/0042615 | A1 * | 3/2006 | Gregory | 124/62 |
| 2009/0050128 | A1 * | 2/2009 | Mitchell | 124/66 |

* cited by examiner

*Primary Examiner* — Samir Abdosh
*Assistant Examiner* — John D Cooper
(74) *Attorney, Agent, or Firm* — Endurance Law Group, PLC

(57) ABSTRACT

A blow gun assembly allows the rapid continuous firing of multiple soft, cylindrical projectiles using a single breath. The assembly includes at least one soft cylindrical projectile with a height generally equal to or slightly greater than its diameter, and a centrally-located breech in fluid communication with a mouthpiece, a vertical magazine, and a barrel. Projectiles loaded into the magazine enter a breech chamber by gravity. Upon receiving a charge of air through the mouthpiece, the projectiles travel successively through the breech chamber and out through the barrel in rapid fashion. Sizing of the magazine, breech chamber, and barrel, relative to the projectile, causes the projectiles to flow through the blow gun in continuous succession without jamming, with projectiles being rotated within the breech chamber to properly align with the barrel.

14 Claims, 6 Drawing Sheets

MULTIPLE SOFT PROJECTILE BLOW GUN

CROSS REFERENCE TO RELATED APPLICATIONS

This application claims the benefit of U.S. Application Ser. No. 61/586,789 filed Jan. 15, 2012.

BACKGROUND OF THE INVENTION

This invention relates to a blow gun assembly, and more particularly to a blow gun assembly for shooting multiple soft projectiles in rapid succession.

People of all ages have been fascinated with suns for generations. Common toys for children include toy guns using soft projectiles, allowing children to have play "wars" and shoot each other without causing injury. Adults also participate m activities where they shoot targets, or each other, mimicking war scenarios. Such captivation with guns has created an interest in blow guns using soft projectiles, such as marshmallows. Blow guns made specifically tot use with marshmallows are sold commercially in a variety of configurations, and may also be homemade, typically using standard commercially available polyvinyl chloride (PVC) plumbing pipe and fittings.

While blow guns have traditionally fired only one shot at a time, the ability to rapidly fire multiple projectiles using a single blast of an (simulating a machine gun) would provide a competitive advantage and significantly increase the user's enjoyment. However, current soft projectile blow guns, whether homemade or sold commercially, are typically hand-loaded for shooting a single projectile at a time (as described in U.S. Pat. No. 4,054,120 to Foley, issued Oct. 18, 1977; U.S. Pat. No. 6,588,413 to Nagasue, issued Jul. 8, 2003; U.S. Pat. No. 6,901,922 to Forti. Forti, and Turchik, issued Jun. 7, 2005; and U.S. Pat. No. 7,578,290 to Mitchell, issued Aug. 25, 2009). Soft projectile guns which include magazines (holding multiple projectiles) typically shoot only one projectile at a time (as described in U.S. Pat. No. 1,152,117 to Sproull, issued Sep. 7, 1915; U.S. Pat. No. 3,137,287 to De Arbun, issued Jun. 16, 1964; U.S. Pat. No. 4,086,902 to Reynolds, issued May 2, 1978; U.S. Pat. No. 5,373,832 to D'Andrade, issued Dec. 20, 1994; U.S. Pat. No. 5,850,826 to Guthrie, issued Dec. 22, 1998; and U.S. Pat. No. 6,347,621 to Guthrie, issued Feb. 19, 2002). Other projectile shooters, such as paintball guns, airsoft guns, and blow guns with magazines for firing multiple projectiles (as described in U.S. Pat. No. 2,580,613 to Seibel and Scotti, issued Jan. 1, 1952; and U.S. Pat. No. 8,220,447 to Harrison, issued Jul. 17, 2012) are limited to use with spherical projectiles, and are therefore unsuitable for use with marshmallows, which are cylindrical. The market lacks a blow gun which can continuously shoot multiple cylindrical soft projectiles in rapid-fife succession.

The use of a gravity-fed, vertical magazine in a blow gun is described in the prior art (as in U.S. Pat. No. 3,124,119 to Ayala, issued Mar. 10, 1964; U.S. Pat. No. 3,388,696 to Hoverath et al, issued Jun. 18, 1968; and Guthrie '826). However, such disclosures in the prior art are intended for use with darts or projectiles having a closely controlled shape and size. Marshmallows, unfortunately, are irregularly sized, making them unsuitable as ammunition in these types of blow guns. In addition, because marshmallows are so easily deformable, they can be much more prone to jamming than other types of projectiles. Marshmallows present a unique challenge to the blow gun designer. Enlarging the magazine and barrel of a blow gun to accommodate the range of individual marshmallow sizes allows migration of unfired marshmallows toward (and out of) the barrel or mouthpiece as the user rotates or moves the gun during play, which is obviously undesirable. Reducing the barrel diameter to restrict passage of the marshmallows (absent a breath of air from the user) causes frequent jams in the breech, as marshmallows become wedged together when trying to enter the barrel.

There exists a need for blow guns which allow rapid continuous firing of multiple soft projectiles without jamming, to provide a competitive advantage and increased enjoyment.

SUMMARY OF THE INVENTION

The present invention comprises a blow gun allowing rapid continuous firing of multiple soft projectiles, particularly those that are somewhat irregularly sized, such as marshmallows. The blow gun includes a mouthpiece, a breech chamber, a tubular magazine, and a barrel, and may also include other features such as a handle. Soft projectiles are loaded into the magazine, which is mounted vertically above a projectile entrance port in the top of the breech chamber. In particular, marshmallows (which are generally cylindrical in shape) or other type of soft projectile are loaded with the central axis of each projectile aligned with the axis of the magazine, such that the projectiles fall into the breech chamber in a "standing" orientation. The projectiles fall freely from the magazine into the breech chamber by gravity. The mouthpiece is fluidly connected to one end of the breech chamber; the barrel is fluidly connected to the opposite end of the breech chamber. Upstream and downstream restrictions at opposite ends of the breech chamber inhibit unintentional projectile movement out of the breech chamber. This prevents projectiles from being sucked in the upstream direction back through the mouthpiece (thus eliminating a choking hazard for the user), and also gently inhibits projectiles from inadvertently sliding out through the barrel in a downstream direction when the blow gun is tilted or moved during play.

Because commercially available marshmallows are irregularly sized, the magazine must accommodate a range of projectile dimensions. Marshmallows (being generally cylindrical in shape), have a projectile diameter (Dp), a height (H) which is typically equal to or slightly greater than the diameter (Dp), and a small radius (R) at each corner. The magazine inner diameter (Dm) must be greater than the diameter (Dp) of the largest usable projectile, to allow that projectile to fall freely through the magazine. However, the magazine inner diameter (Dm) should also be smaller than the "cross-corner" dimension (CC) [calculated as $\sqrt{(Dp^2+H^2)}-2R(\sqrt{2}-1)$] of the smallest projectile used, to discourage marshmallows from being loaded in a "sideways" orientation or from rotating into the "sideways" orientation as they travel through the magazine (which can cause jamming in the magazine). Viewed from another perspective, for any particular magazine inner diameter (Dm), these limits [$Dp<Dm<\sqrt{(Dp^2+H^2)}-2R(\sqrt{2}31$ 1)] define the range of suitable projectile sizes. The breech chamber diameter (Db) must be at least approximately equal to the magazine diameter (Din) to allow any projectile which falls freely from the magazine to enter the breech chamber. But the breech chamber diameter (Db) must not be so large as to allow two smaller projectiles to pass simultaneously (which causes jamming at the downstream restriction). The best result (widest range of suitable projectile sizes) is obtained when the breech chamber diameter is minimized (made approximately equal to the magazine inner diameter (Dm)).

A suitably sized projectile which enters the breech chamber from the magazine in a "standing" orientation will come to rest in the breech chamber with some portion of the projectile outside of the breech chamber's cylindrical diameter (i.e. extending into the projectile entrance port). Air blown through the mouthpiece into the breech chamber moves the bottom portion of the projectile away from the mouthpiece, causing the projectile to tip and rotate, such that it becomes aligned with the breech chamber as it moves therethrough. The projectile is then pushed into and through the barrel, and forcibly ejected, by air pressure from the user's breath. As each projectile exits the breech chamber, the next projectile (incoming from the magazine) falls into the breech chamber, and is rotated and blown out of the barrel. Subsequent projectiles continue to fall from the magazine, rotate, and be discharged through the barrel, in similar fashion, until the supply of projectiles is exhausted or the inlet air flow is interrupted. In this way, the blow gun operates as a "fully automatic" soft projectile shooter.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
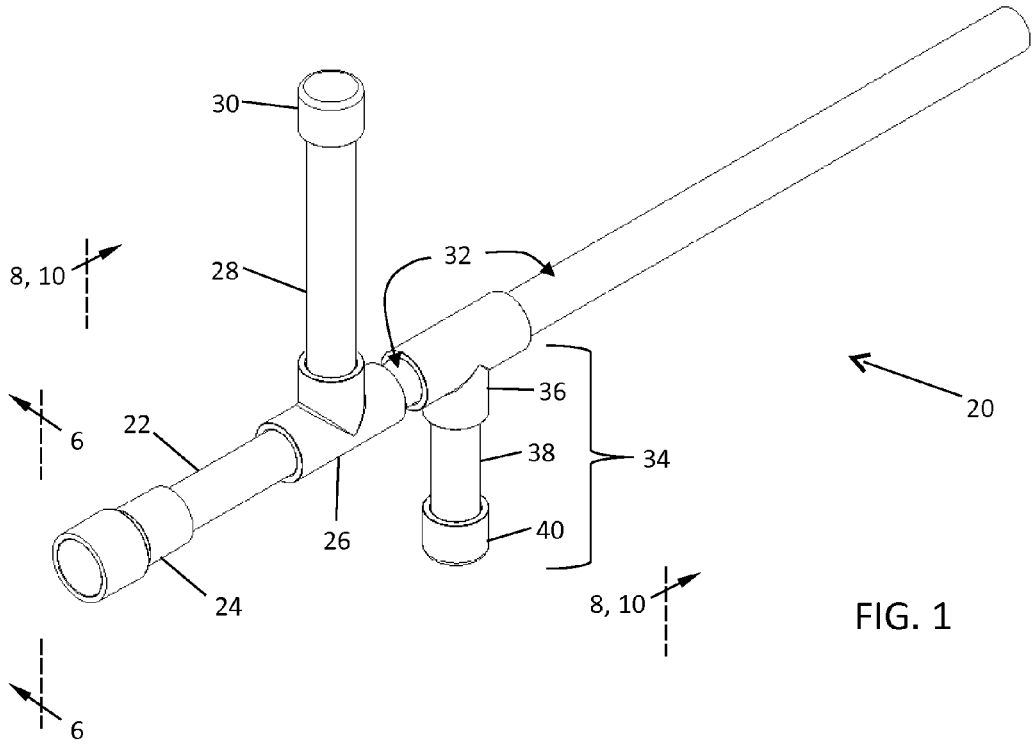
FIG. 1 is a perspective view of the preferred embodiment of the present invention.

Referring to the Figures, wherein like numerals indicate like or corresponding parts throughout the several views. FIG. 1 shows a blow gun assembly 20 for rapid continuous tiring of multiple soft cylindrical projectiles 42 using a single breath. The blow gun assembly 20 is generally comprised of a mouthpiece 22, an enlarged mouthpiece tip 24, a breech assembly 26, a tubular magazine 28, a removable magazine cap 30, an elongated barrel 32, a handle assembly 34 comprising a coupling 36, a handle tube 38, and a handle cap 40, and generally cylindrical soft projectiles 42 (shown in FIGS. 2-5). The centerlines of these components are coplanar, and the blow gun assembly 20 is normally oriented with this plane, and the centerline of the magazine 28, in the vertical position during use.

Figure 2:
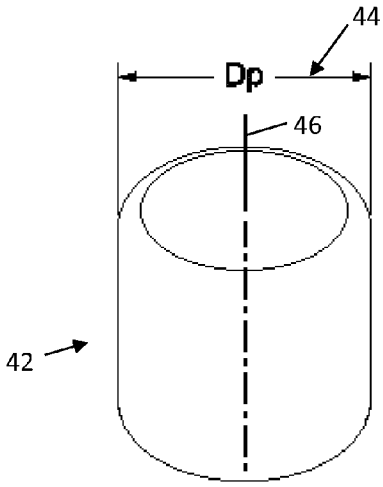
FIG. 2 is an enlarged perspective view of a single projectile illustrating its diameter and central axis.

FIG. 2 shows an enlarged view of a soft cylindrical projectile 42, having a diameter (Dp) 44 and a central axis 46 passing through the center of each end of the projectile 42.

Figure 3:
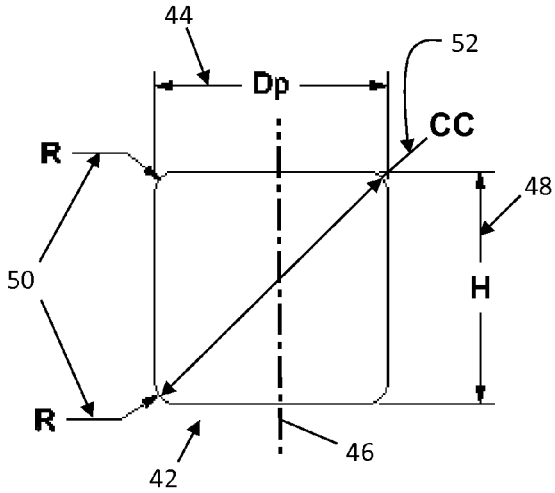
FIG. 3 is an enlarged side view of a single projectile illustrating its dimensions.

FIG. 3 shows an enlarged side view of a projectile 42, having a height (H) 48, and a small radius (R) 50 around each edge. The diagonal "cross-corner" dimension (CC) 52 of the projectile 42 is greater than its diameter (Dp) 44, a fact which plays an important role in the design of the blow gun 20 (not shown). This "cross-corner" dimension (CC) 52 can be calculated as $CC=\sqrt{(Dp^2+H^2)}-2R(\sqrt{2}-1)$. In practice, the preferred projectile 42 is a standard mini-marshmallow, which is generally cylindrical in shape and has a height (H) 48 which is generally equal to or slightly greater than its diameter (Dp) 44. The dimensions of commercially available marshmallows are not tightly controlled, although manufacturers do try to maintain reasonable uniformity. Both the diameter (Dp) 44 and the height (H) 48 of marshmallows exhibit some variation between individual marshmallows. The blow gun 20 (not shown) must be capable of reliably firing projectiles 42 of varying size.

Figure 4:
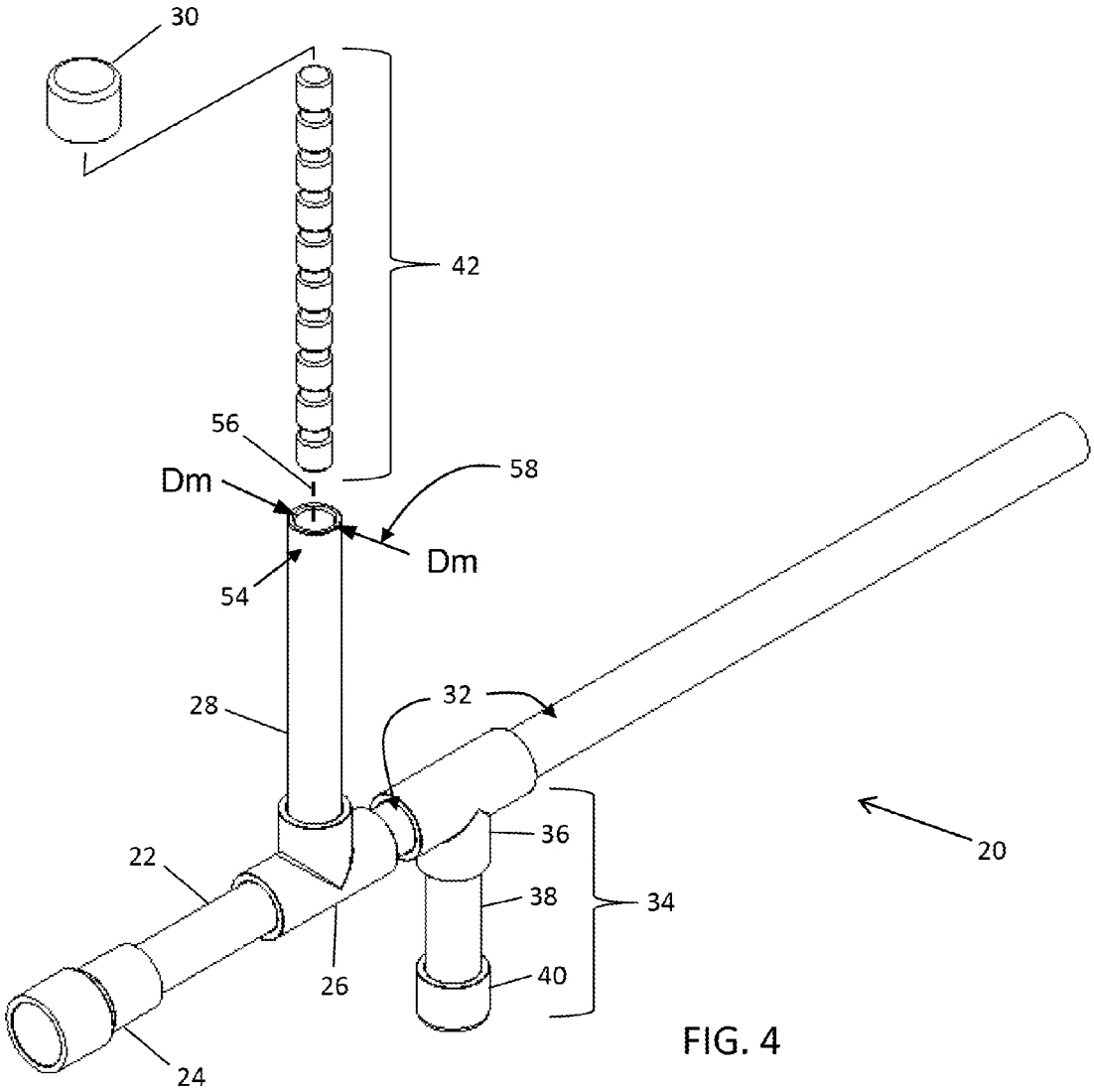
FIG. 4 is a partially exploded view of the invention illustrating loading of the projectiles.

FIG. 4 shows the blow gun assembly 20 and demonstrates how one or more cylindrical projectiles 42 may be loaded into the magazine 28. The magazine cap 30 is removed from the loading end 54 of the magazine 28 and one or more projectiles 42 are dropped into the magazine 28, one on top of another. After loading, the magazine cap 30 is replaced (as shown in FIGS. 1 and 5) to seal the loading end 54 of the magazine 28, and the blow gun 20 is armed and ready for use.

Each projectile 42 is loaded into the magazine 28 with its central axis 46 parallel to the centerline 56 of the magazine 28. The generally circular inner diameter (Dm) 58 of the magazine 28 must be large enough to accept the projectile 42 and allow it to fall freely by gravity) through the magazine 28. That is, the inner diameter (Din) 58 of the magazine 28 must be greater than the diameter (Dp) 44 of the projectile 42. However, the inner diameter (Dm) 58 of the magazine 2$ should be small enough to inhibit the loading of a projectile 42 with its central axis 46 (not shown) perpendicular to the centerline 56 of the magazine 78. That is, the inner diameter (Dm) 58 of the magazine 28 should be smaller than the "cross-corner" dimension (CC) 52 of the projectile 42. Viewed from another perspective, for any particular inner diameter (Din) 58 of the magazine 28, these limits $[Dp<Dm<\sqrt{(Dp^2+H^2)}-2R(\sqrt{2}-1)]$ define the range of usable sizes for the projectiles 42.

Figure 5:
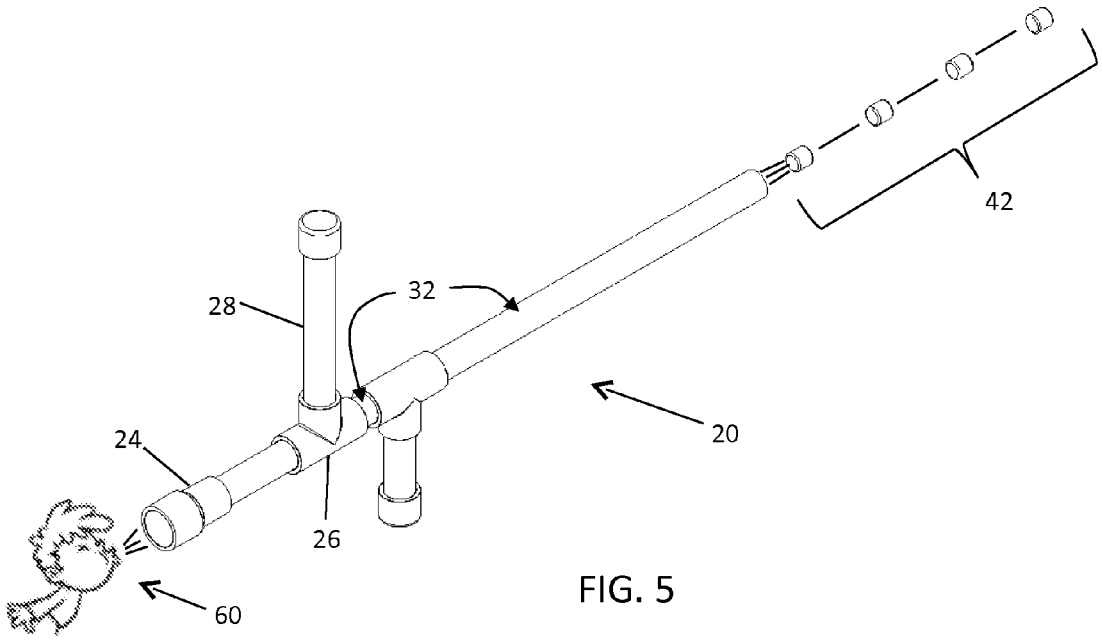
FIG. 5 is a perspective view illustrating the operation of the invention.

FIG. 5 illustrates the use of the blow gun 20. Once the projectiles 42 (not shown) are loaded inside the magazine 28, a charge of air 60 from the user's breath is directed into the mouthpiece tip 24, which causes continuous, successive passage of the projectiles 42 not shown) through the breech assembly 26 and elongated barrel 32, producing a rapid-fire burst of projectiles 42 from the elongated barrel 32.

Figure 6:
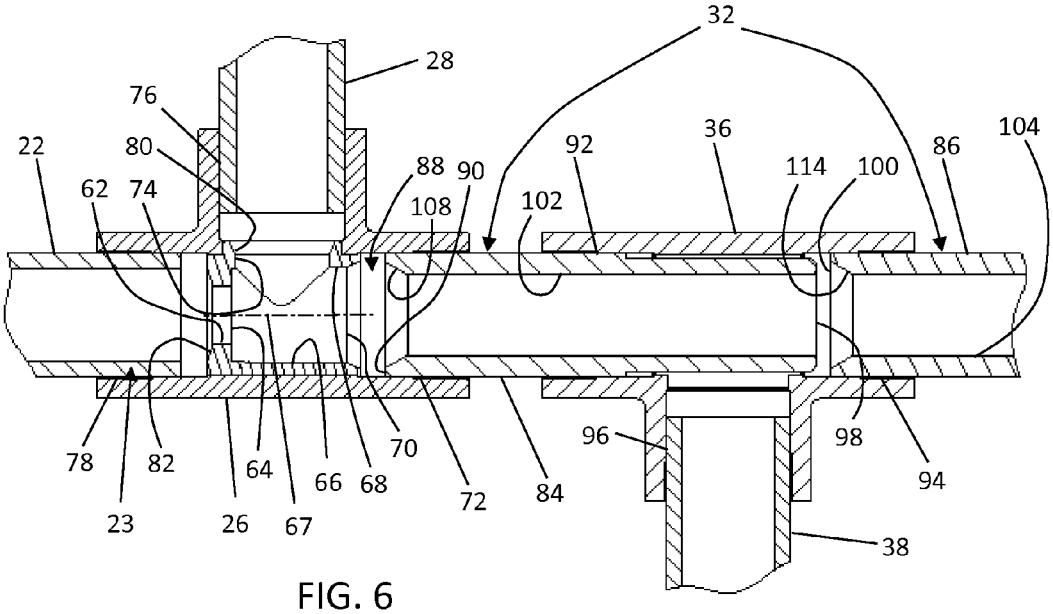
FIG. 6 is a sectional view of the central portion of the invention.

FIG. 6 shows a longitudinal cross-section of the central portion of the blow gun 20. The breech assembly 26 includes an air inlet port 62 at the proximal end 64 of a generally cylindrical breech chamber 66, a projectile discharge port 68 at the distal end 70 of the breech chamber 66 having a central axis 67 centered along its inner diameter (Db) 112 (see FIG. 7), a generally circular connector tube mounting bore 72 which is concentric with, adjacent to, and fluidly connected to the projectile discharge port 68, a generally circular projectile entrance port 74, in open communication with the breech chamber 66, and whose centerline intersects and is perpendicular to the central axis 67 of the breech chamber 66, a generally circular magazine mounting bore 76 which is concentric with, adjacent to, and fluidly connected to the projectile entrance port 74, and a generally circular mouthpiece mounting bore 78 which is adjacent, and fluidly connected, to the air inlet port 62. The distal end 23 of the mouthpiece 22 is permanently mounted in the mouthpiece mounting bore 78, in open fluid communication with the air inlet port 62, allowing a charge of air 60 to be transmitted in a longitudinally forward direction through the air inlet port 62 and into the distal end 64 of the breech chamber 66. The mouthpiece tip 24 is permanently mounted to the proximal end (not shown) of the mouthpiece 22. In operation, the blow gun 20 is held with the projectile entrance port 74 pointing in the upward vertical direction. The magazine 28 is detachably mounted to and in open communication with the magazine mounting bore 76, above the projectile entrance port 74 in the top of the breech chamber 66. The inner diameter (Din) 58 (see FIG. 7) of the magazine 28, the projectile entrance port 74, and the breech chamber 66 are all generally equal in size to allow the projectiles 42, to fall freely from the magazine 28, through the projectile entrance port 74 and into the breech chamber 66 by gravity. The projectile entrance port 74 is adjacent to the proximal end 64 of the breech chamber 66, and includes a conical transition zone 80 on the side of the port closest to the magazine 28, to facilitate smooth passage of the projectiles 42 from the magazine 28 into the entrance port 74. The breech chamber 66 is sized such that only one projectile at a time can enter from the magazine 28; a projectile 42 cannot fall into the breech chamber 66 until the preceding projectile 42 has moved to clear the area beneath the projectile entrance port 74. The air inlet port 62 is significantly smaller than the smallest diameter (Dp) 44 of the projectiles 42. This prevents the projectiles 42 from entering the mouthpiece 22, avoiding accidental inhalation of the projectiles 42 by the user. The upstream side of the air inlet port 62 includes a chamfer, edge break, rounded edge, or similar profile 82, to inhibit the creation of whistling noises as the charge of air 60 is blown through the air inlet port 62. The distance between the proximal end 64 and the distal end 70 of the breech chamber 66 is greater than the projectile diameter (Dp) 44, to accommodate the projectile entrance port, but less than three times the projectile diameter (Dp) 44, to prevent the accumulation of more than two projectiles 42 (not shown) inside the breech chamber.

The elongated barrel 32 comprises a connector tube $4 and a barrel extension 86. The connector tribe 84 is permanently mounted in the connector tube mounting bore 72 adjacent to, and in open communication with, the projectile discharge port 68 in the breech assembly 26. An interstitial space 88 is provided between the proximal end 90 of the connector tube 84 and the distal end 70 of the breech chamber 66, so that excess material (glue, melted plastic, etc.) resulting from the joining of the connector tribe 84 to the connector tube mounting bore 72 does not obstruct the travel path of the projectiles 42.

The handle assembly 34, interposed between the connector tube. 84 and the barrel extension 86, comprises a handle coupling 36, a handle tube 38, and a handle cap 40. The handle coupling 36 includes a generally circular connector tube mounting bore 92 at one end, a generally circular barrel extension mounting bore 94 at the opposite end, and a generally circular handle mounting bore 96. The connector tube mounting bore 92 is concentric with the barrel extension mounting bore 94, supporting the connector tribe 84 and the barrel extension $6 in axially aligned end-to-end fashion. The connector tube 84 extends through the center of the handle coupling 36, such that the distal end 98 of the connector tube 84 is in close proximity to the proximal end 100 of the barrel extension 86. This alignment and proximity assures smooth passage of the projectiles 42 from the connector tube bore 102 into the barrel extension bore 104. The centerline of the handle mounting bore 96 intersects and is perpendicular to the common centerline between the connector tube mounting bore 92 and barrel extension mounting bore 94. The handle tube 38 is permanently mounted in the handle mounting bore 96, and the handle cap 40 is permanently mounted to the end of the handle tube 38 opposite the handle coupling 36.

The connector tube 84 is permanently mounted in the connector tube mounting bore 92 of the handle coupling 36, with the centerline of the handle tube 38 parallel to the centerline of the magazine mounting bore 76, and the handle tube 38 on the opposite side of the blow gun 20 from the magazine mounting bore 76. Because permanently mounting the connector tube 84 to both the breech assembly 26 and the handle coupling 36 permanently fixes the alignment of the handle coupling 36 to the breech assembly 26, it assures the permanent, proper angular relationship (180° opposite) between the magazine 28 and the handle tube 38. The barrel extension 86 is detachably mounted in the barrel extension mounting bore 94 of the handle coupling 36, allowing the blow gun 20 to be partially disassembled for transport, storage, or cleaning. It would be possible to combine the connector tube 84, handle assembly 34, and barrel extension 86 into a single part, but this would either prevent disassembly (if the connector tube 84 were to remain permanently mounted in the connector tube mounting bore 72 of the breech assembly 26), or allow misalignment of the handle tube 38 with respect to the magazine 28 (if the connector tube 84 was detachably mounted in the connector tube mounting bore 72 of the breech assembly 26). Neither of these options is desirable.

Figure 7:
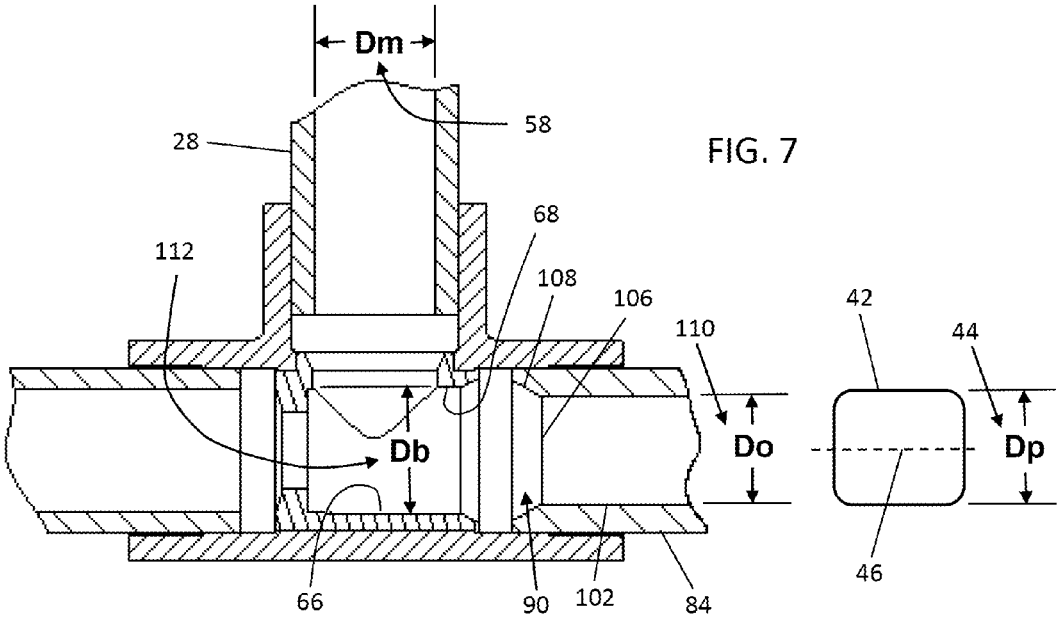
FIG. 7 is an enlarged sectional view of the breech portion of the invention.

FIG. 7 shows the diametrical relationships of the magazine 28, breech chamber 66, and connector tube 84. The proximal end 90 of the connector tube 84 includes a generally circular bore opening 106 and a bore entrance chamfer 108. The diameter (Do) 110 of the bore opening 106 is less than the diameter (Db) 112 of the breech chamber 66, and is generally equal to or smaller than the diameter (Dp) 44 of the projectiles 42. This constitutes a restriction which prevents projectiles from inadvertently sliding through the connector tube 84 and barrel extension 86, absent a charge of air 60 from the user's breath. Furthermore, the remainder of the connector tube bore 102 and the barrel extension bore 104 are generally circular and have diameters generally equal to the diameter (Do) 110 of the bore opening 106. This constrains the projectiles 42 to conform to the connector tube bore 102 and the barrel extension bore 104, which eliminates most air leakage around the projectiles as they are fired, increasing the pneumatic pressure behind the projectiles 42 as they travel through the connector tube 84 and barrel extension 86, thereby potentially increasing the power and range of the projectiles 42. The largest diameter of the bore entrance chamfer 108 is larger than the diameter of the projectile discharge port 68. The bore entrance chamfer 108 provides a smooth frusto-conical transition between the projectile discharge port 68 and the bore opening 106, to prevent jamming; of the projectiles as they pass from the projectile discharge port 68 into the connector tube bore 102. Referring back to FIG. 6, the proximal end 100 of the barrel extension. 86 includes a conical entrance chamfer 114 similar to the bore entrance chamfer 108 of the connector tube 84.

The relationships between the projectile dimensions (i.e., the diameter (Dp) 44, height (H) 48, and corner radius (R) 50), the magazine inner diameter (Dm) 58, the breech chamber diameter (Db) 112, and the connector tube bore opening diameter (Do) 110, as well as the cylindrical shape of the projectiles 42 (marshmallows), are important to the proper function of the blow gun 20. If the proper relationships between these dimensions are not maintained, the blow gun 20 (not shown) will not reliably provide rapid, continuous firing of multiple soft projectiles 42 using a single charge of air 60 without jamming. Since the dimensions of commercially available marshmallow projectiles 42 are not tightly controlled, the magazine inner diameter (Dm) 58, the breech chamber diameter (Db) 112, and the connector tube bore opening diameter (Do) 110 moist be controlled within a reasonable tolerance, in order for the blow gun 20 to function properly using the broadest possible range of projectile 42 sizes encountered. The important dimensional relationships may he expressed as follows:

$$Dp<Dm<\sqrt{(Dp^2+H^2)}-2R(\sqrt{2}-1)$$

$$Db\approx Dm$$

$$Do\leq Dp<Db$$

The magazine inner diameter (Dm) 58 must be larger than the projectile diameter (Dp) 44 to allow the projectile 42 to fall freely (by gravity) through the magazine 28. The breech chamber diameter (Db) 112 must be approximately equal to the magazine inner diameter (Dm) 58, so that the projectile 42 will continue to fall into the breech chamber 66 after leaving the magazine.

Figure 8:
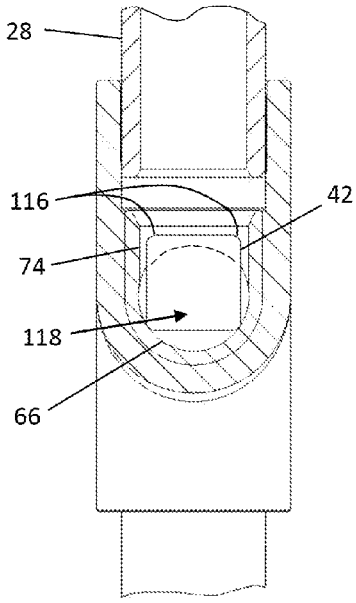
FIG. 8 is a sectional view showing the position of a single (typical) projectile after it has entered the breech chamber from the magazine.

FIG. 8 shows the position of a typical projectile 42 after exiting the magazine 28 and coming to rest in the breech chamber 66. Because the breech chamber diameter (Db) 112 is approximately equal to the magazine inner diameter (Dm) 58, and the magazine inner diameter (Din) 58 is less than the "cross-corner" dimension (CC) 52 of the projectile 42, the upper corners 116 of the projectile 42 remain in the projectile entrance port 74. Then, when a charge of air 60 is introduced through the air inlet port 62, the bottom portion 118 of the projectile 42 is pushed longitudinally forward towards the projectile discharge port 68. Since the upper corners 116 of the projectile 42 are constrained by the projectile entrance port 74, the projectile tips (rotates). As the bottom portion 118 of the projectile 42 continues to move toward the projectile discharge port 68, the projectile 42 is re-oriented such that the central axis 46 of the projectile 42 becomes basically aligned with the central axis 67 of the breech chamber 66, and the centerlines of the connector tube 84 and barrel extension 86. The projectile 42 is then blown out through the connector tube 84 and barrel extension 86.

Figure 9:
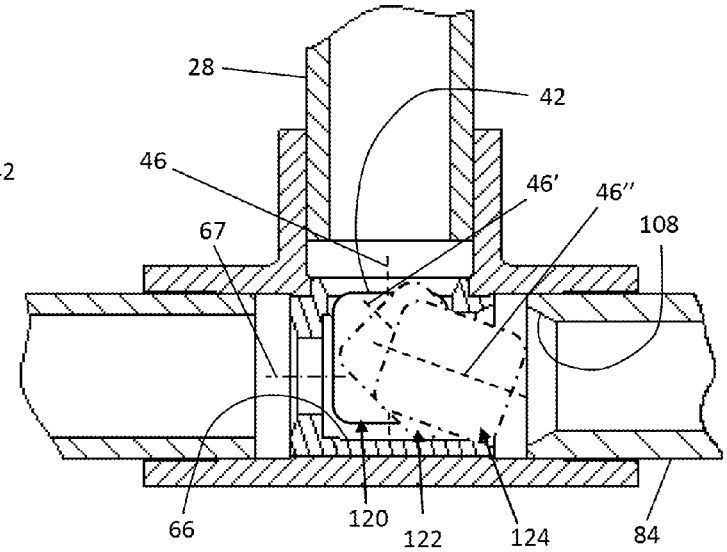
FIG. 9 is a sectional view illustrating the travel of a single (typical) projectile through the breech chamber.

FIG. 9 illustrates the travel of a single projectile 42 through the breech chamber 66, showing a first position 120 (the position alter the projectile 42 has entered the breech chamber 66, where the central axis 46 of the projectile 42 is perpendicular to the central axis 67 of the breech chamber 66), a second (subsequent) rotated position 122 (where the central axis 46' has rotated to a 45 inclination with respect to the central axis 67 of the breech chamber 66), and a third (subsequent) further rotated position 124 (where the central axis 46" has rotated to a 20° inclination with respect to the central axis 67 of the breech chamber 66). The projectile 42 continues to rotate until it is basically aligned with the bore 102 of the connector tube 84, finally assisted by the bore entrance chamfer 108. Rotation of each projectile 42 in the breech chamber 66 promotes smooth flow of projectiles 42 through the connector tube 84 and barrel extension 86, by presenting each projectile 42 in a favorable orientation for entering the bore entrance chamfer 108 of the connector tube 84.

Figure 10:
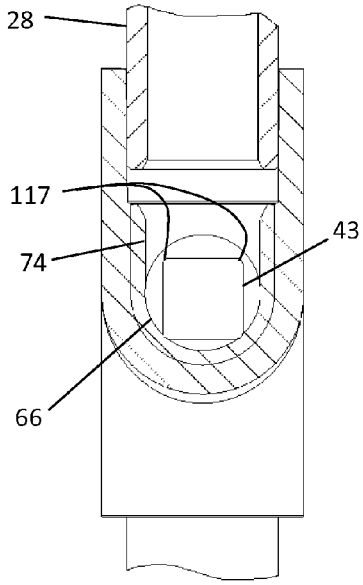
FIG. 10 is a sectional view showing the position of a single (small) projectile after it has entered the breech chamber from the magazine.

FIG. 10 shows the position of an unusually small projectile 43 after exiting the magazine 28 and coming to rest in the breech chamber 66. Here, the upper corners 117 of the small projectile 43 fall completely within the breech chamber diameter (Db) 112. Therefore, when a charge of air 60 is introduced through the air inlet port 62, the small projectile 43 is blown directly through the breech chamber 66 in the "sideways" orientation (that is, with the central axis 47 of the small projectile 43 perpendicular to the central axis 67 of the breech chamber 66).

Figure 11:
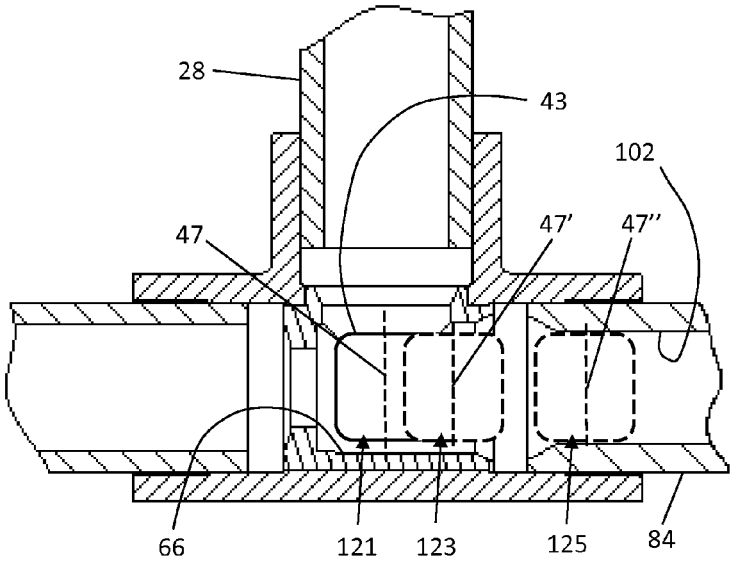
FIG. 11 is a sectional view illustrating the travel of a single (small) projectile through the breech chamber.

FIG. 11 illustrates the travel of a single small projectile 43 through the breech chamber 66, showing a first position 121 (the position after the small projectile 43 has entered the breech chamber 66), a second (subsequent) position 123, and a third (subsequent) position 125 (Where the small projectile 43 has travelled into through the connector tube 84). The central axis 47 of the small projectile 43 remains in its original orientation (shown at first position 121) as the small projectile 43 travels through the second position 123 (central axis 47') and third position 125 (central axis 47"). Thus, the orientation of a small projectile will remain unchanged as it travels through the breech chamber 66.

Because of the size of the small projectile 43, it is likely that, if the small projectile 43 rotates into the "aligned" orientation in the breech chamber, it could easily slide out through the connector tube 84 and barrel extension 86 without the user blowing through the blow gun 20. However, when the small projectile 43 maintains a "sideways" orientation, this presents the "cross-corner" dimension (CC) 52 to the connector tube bore 102 and the barrel extension bore 104, providing better retention for "loose" projectiles, and providing a better pressure seal against the connector tube bore 102 and the barrel extension bore 104 when fired.

In operation, then, the blow gun 20 allows only one projectile 42 at a time to pass through the breech chamber 66, and causes typical projectiles 42 to rotate so that they become aligned with the connector tube bore 102 and barrel extension bore 104. This greatly reduces the likelihood of jams occurring in the breech chamber 66 or at the connector tube bore entrance chamfer 108, providing reliable operation and increased enjoyment. Additionally, the size relationship between the projectiles 42/43 and the breech chamber 66 provides a self-orienting function, where typical/large projectiles 42 are rotated into alignment with the connector tube bore 102 and barrel extension bore 104, while small projectiles 43 can remain in a "sideways" orientation providing better containment and sealing within the bores 102 and 104.

The controlled relationship between the projectile dimensions (i.e., diameter (Dp) 44, height (H) 48, and corner radius (R) 50), the magazine inner diameter (Dm) 58, the breech chamber diameter (Db) 112, and the connector tube bore opening diameter (Do) 110, and the cylindrical shape of the projectiles 42 (e,g., marshmallows), allow the blow gun 20 to reliably provide continuous rapid firing of multiple soft projectiles on a single breath of air, providing the user with a distinct advantage over all other commercially available marshmallow shooters.

Most of the components for the blow gun 20 may be fabricated, using standard commercial polyvinylchloride (PVC) plumbing pipe and fittings, joining them permanently (where desired) using PVC cement. The barrel extension 86 and connector tube 84 may be fabricated using inch nominal size Schedule 80 PVC pipe, with conical chamfers 108 and 114 machined at their proximal ends 90 and 100 using a suitable chamfering tool, such as a zero flute deburring tool. The magazine 28 may be fabricated using ½ inch nominal size Schedule 40 PVC pipe. The mouthpiece 22 and handle tube 38 may be fabricated using ½ inch nominal size Schedule 40 or Schedule 80 PVC pipe. Unaltered commercial inch nominal size PVC plumbing fittings may be used for the handle coupling 36, magazine cap 30, and handle cap 40. A commercially available V2 inch nominal size to inch nominal size PVC reducing fitting may be used for the mouthpiece tip 24.

The breech assembly 26 may be fabricated using a commercial ½ inch nominal size PVC tee fitting, however, additional material must be added to the fitting to form the breech chamber 66, projectile entrance port 74, air inlet port 62, and projectile discharge port 68 (whose diameters are less than the inner diameters of the unaltered fitting). This may be accomplished by filling all or part of the tee fitting with a suitable material (such as an epoxy filler), and then machining away the excess material as required.

Figure 12:
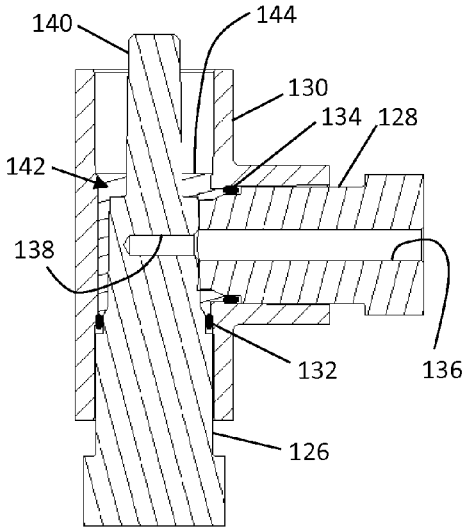
FIG. 12 is a sectional dew of the breech assembly as it may be produced by the use of molding inserts.
Figure 13:
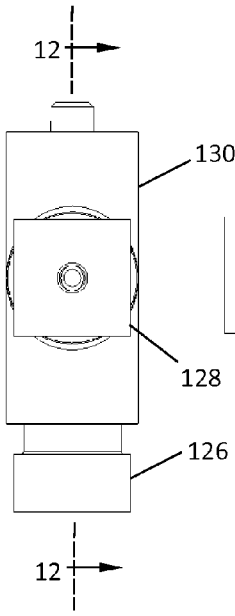
FIG. 13 is a front view of the breech assembly with molding inserts installed.
Figure 14:
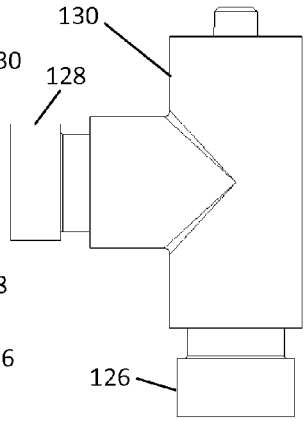
FIG. 14 is a side view of the breech assembly with molding, inserts installed.

FIG. 12 through 14 illustrate a method of fabricating the breech assembly 26 using a main insert 126 and an entrance port insert 128 which are machined from polytetrafluoroethylene (PTFE) bar stock material. The main insert 126 and entrance port insert 128 are machined with slight draft angles to facilitate removal from the finished part. The main insert 126 is installed into one end of an unmodified ½ inch PVC tee fitting 130, using a silicone O-ring 132 to provide a seal between the main insert 126 and the inner end of what will become the connector tube mounting bore 72 of the finished breech assembly 26 (see FIG. 6). The entrance port insert 128 is then installed into the side arm of the tee fitting 130, again using a silicone O-ring 134 to provide a seal between the entrance port insert 128 and the fitting 130. The entrance port insert 128 is secured to the main insert 126 using a retaining screw which passes through a central bore 136 in the entrance port insert 128 and engages a threaded hole 138 in the main insert 126. The tee fitting 130 is then positioned with the tip 140 of the main insert 126 (which will form the air inlet port 62, see FIG. 6) pointing up, and the central cavity 142 of the tee 130 is filled with liquid polyurethane 144, by injecting the polyurethane 144 (using a syringe with a large bore hypodermic needle) through the open bore at the top of the tee 130. Polyurethane 144 is added to the tee 130 until the surface of the liquid pool reaches the lower edge of the open tee bore (which will become the mouthpiece mounting bore 78 of the finished breech assembly 26, see FIG. 6). After the polyurethane 144 hardens, the retaining screw, entrance port insert 128, main insert 126, and 0-rings 132 and 134 are removed, excess flash around the projectile entrance port chamfer 80 (see FIG. 6) is machined away, and the air inlet port chamfer 82 (see FIG. 6) is machined, leaving the completed breech assembly 26.

Figure 15:
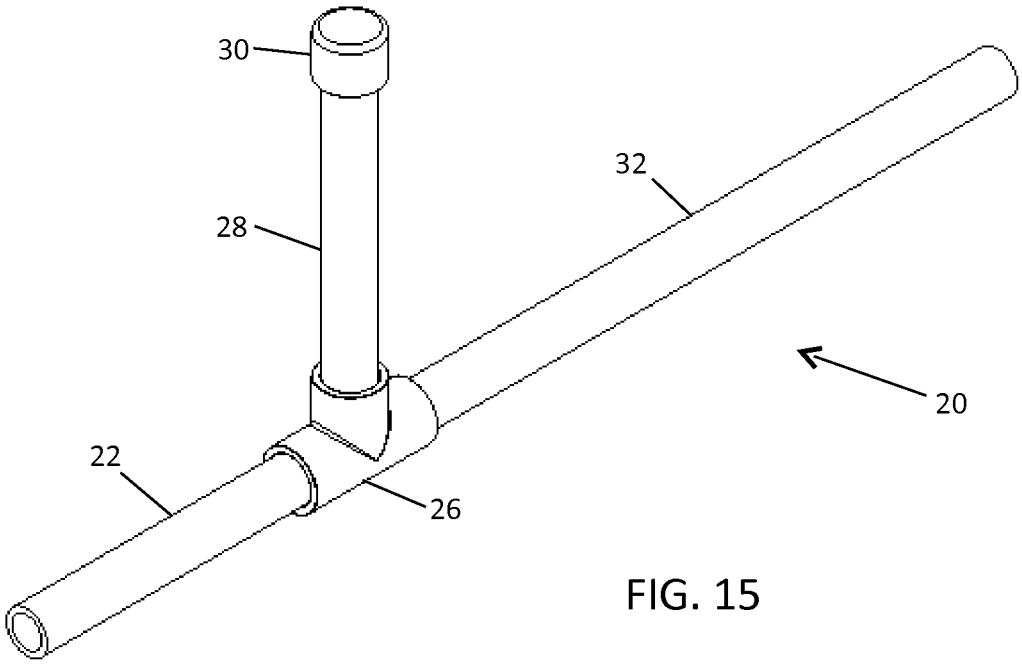
FIG. 15 is a perspective view of an alternate embodiment of the invention.

Other configurations for the blow gun 20, such as omitting the handle assembly 34 and connector tube 84, by mounting the barrel extension 86 directly to the connector tube mounting bore 92, and/or omitting the mouthpiece tip 24, may obviously be contemplated (see FIG. 15). Other manufacturing methods, such as plastic injection molding, may also be utilized.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is

1. A blow gun assembly for rapid continuous-firing multiple soft cylindrical projectiles using a single breath, said assembly comprising:

a plurality of substantially cylindrical soft projectiles, each of said projectiles having diameter (Dp) and a height (H) and collier radii (R), each said projectile having a central axis centered along said projectile diameter (Dp), a mouthpiece configured to transmit a charge of air in a longitudinally forward direction, a breech, said breech defining a cylindrical internal breech chamber having a circular inner diameter (Db) and a proximal end and a distal end, said proximal end of said breech adjoining said mouthpiece in open fluid communication, said breech chamber having a central axis centered along said breech chamber inner diameter (Db), said breech including a circular projectile entrance port, said projectile entrance port having a diameter substantially equal to said breech chamber inner diameter (Db), a tubular magazine for storing said projectiles in a stacked array, said magazine having an internal diameter (Dm), said magazine having a discharge end in communication with said projectile entrance port of said breech chamber, said magazine configured to feed said projectiles sequentially into said breech chamber with said central axis of each said projectile oriented substantially perpendicular to said central axis of said breech chamber, an elongated barrel extending longitudinally from said distal end of said breech, said barrel having a bore opening in direct communication with said distal end of said breech chamber, an upstream restriction between said mouthpiece and said proximal end of said breech chamber, and a downstream restriction adjacent to said distal end of said breech chamber, and said diameter (Dm) of said magazine being greater than said projectile diameter (Dp) and less than $\sqrt{(Dp^2+H^2)}-2R(\sqrt{2}-1)$.

2. The assembly of claim 1 wherein said diameter (Db) of said breech chamber is approximately equal to said magazine internal diameter (Dm).

3. The assembly of claim 2 wherein said projectile entrance port is adjacent to said proximal end of said breech chamber.

4. The assembly of claim 2 wherein said bore opening is circular and has a diameter (Do) which is less than said inner diameter (Db) of said breech chamber, said bore opening comprising said downstream restriction.

5. The assembly of claim 4 wherein said bore opening includes a frusto-conical transition from said inner diameter (Db) of said breech chamber to said bore opening diameter (Do).

6. The assembly of claim 2 wherein the distance between said proximal end of said breech chamber and said distal end of said breech chamber is greater than said projectile diameter (Dp) and less than three times said projectile diameter (Dp).

7. The assembly of claim 2 wherein said magazine includes a loading end opposite said discharge end, and a removable cap covering said loading end.

8. The assembly of claim 2 further including a handle extending laterally from said barrel.

9. The assembly of claim 8 wherein said barrel comprises a connector tube and a barrel extension, said handle including a coupling, said handle coupling supporting said connector tube and said barrel extension in axially aligned end-to-end fashion.

10. The assembly of claim 9 wherein said connector tube and said barrel extension are in close proximity to one another.

11. The assembly of claim 2 wherein said mouthpiece includes a proximal end and a distal end, said distal end being fluidly connected to said breech, and said proximal end including an enlarged tip.

12. The assembly of claim 2 wherein said upstream restriction comprises an orifice, said orifice having an upstream side and a downstream side, and said orifice having a diameter smaller than said projectile diameter (Dp).

13. The assembly of claim 12 wherein said upstream side of said orifice includes at least one of a chamfer and an edge break and a rounded edge.

14. A blow gun assembly for rapid continuous-firing multiple soft cylindrical projectiles using a single breath, said assembly comprising:

a plurality of substantilly cylindrical soft projectiles, each said projectile having a diameter (Dp) and a height (H) and corner radii (R), each said projectile having a central axis centered along said projectile diameter (Dp), a mouthpiece configured to transmit a charge of air in a longitudinally forward direction, said mouthpiece including, a proximal end and a distal end, said proximal end including an enlarged tip, a breech, said breech defining a cylindrical internal breech chamber having a circular inner diameter (Db) and a proximal end and a distal end, the distance between said proximal end of said breech chamber and said distal end of said breech chamber being greater than said projectile diameter (Dp) but less than three times said projectile diameter (Dp), said proximal end of said breech adjoining said distal end of said mouthpiece in open fluid communication, said breech chamber having a central axis centered along said breech chamber inner diameter (Db), said breech including a projectile entrance port adjacent to said proximal end, said projectile entrance port having a diameter substantially equal to said breech chamber inner diameter (Db), an air inlet port between said mouthpiece and said proximal end of said breech chamber, said air inlet port having an upstream side and a downstream side, said air inlet port having a diameter which is less than said projectile diameter (Dp), said upstream side of said air inlet port including at least one of a chamfer and an edge break and a rounded edge, an elongated band extending longitudinally from said distal end of said breech, said barrel having a bore opening in direct communication with said distal end of said breech chamber, said bore opening being circular and having a diameter (Do) which is less than said inner diameter (Db) of said breech chamber and less than or equal to said projectile diameter (Dp), said bore opening including a frusto-conical transition from said inner diameter (Db) of said breech chamber to said bore opening diameter (Do), a tubular magazine for storing said projectiles, said magazine having an internal diameter (Dm), said magazine having a discharge end in communication with said projectile entrance port of said breech chamber, said magazine configured to sequentially feed said projectiles into said breech chamber with said central axis of said projectiles oriented substantially perpendicular to said central axis of said breech chamber, said magazine including a loading end opposite said discharge end, said magazine including a removable cap covering said loading end, a handle extending laterally from said barrel, said handle being generally parallel to said magazine, said handle being located on an opposite side of said assembly from said magazine, said barrel comprising a connector tube and a barrel extension, said handle including a coupling, said handle coupling supporting said connector tube and said barrel extension in axially aligned end-to-end fashion, said connector tube and said barrel extension being in close proximity to one another, and said diameter (DM) of said magazine being greater than said projectile diameter (Dp) and less than $\sqrt{(Dp^2+H^2)}-2R(\sqrt{2}-1)$, and said diameter (Db) of said breech chamber being approximately equal to said magazine internal diameter (Dm).

* * * * *